US007640930B2

(12) United States Patent
Little et al.

(10) Patent No.: US 7,640,930 B2
(45) Date of Patent: Jan. 5, 2010

(54) AIR-INLET ASSEMBLY FOR A GAS COOKING APPLIANCE

(75) Inventors: Derrick Douglas Little, Louisville, KY (US); Erick Paul Graven, Louisville, KY (US)

(73) Assignee: General Electric Company, Schenectady, NY (US)

( * ) Notice: Subject to any disclaimer, the term of this patent is extended or adjusted under 35 U.S.C. 154(b) by 190 days.

(21) Appl. No.: 10/811,667

(22) Filed: Mar. 29, 2004

(65) Prior Publication Data

US 2004/0177841 A1 Sep. 16, 2004

Related U.S. Application Data

(63) Continuation-in-part of application No. 10/248,973, filed on Mar. 6, 2003, now Pat. No. 6,729,323.

(51) Int. Cl.
*F24C 15/10* (2006.01)

(52) U.S. Cl. ..... 126/214 R; 126/39 E; 126/39 N

(58) Field of Classification Search ..... 126/39 E, 126/39 N, 39 BA, 211, 214 R, 215
See application file for complete search history.

(56) References Cited

U.S. PATENT DOCUMENTS 2,452,715 A * 11/1948 Bauer ..... 126/21 R
2,569,652 A * 10/1951 Berg ..... 126/21 R
3,645,249 A 2/1972 Henderson et al.
3,734,681 A 5/1973 Perl
4,236,503 A * 12/1980 Kemp ..... 126/215
4,899,028 A * 2/1990 Arai et al. ..... 219/623
5,450,840 A * 9/1995 Kozdas ..... 126/42
5,653,219 A 8/1997 Taplan
5,808,278 A * 9/1998 Moon et al. ..... 219/506
6,050,893 A * 4/2000 Waite ..... 454/349
6,067,980 A * 5/2000 Kahlke et al. ..... 126/214 R
6,234,161 B1 * 5/2001 Levi et al. ..... 126/21 R
6,497,276 B2 * 12/2002 Clark et al. ..... 165/206
6,807,962 B2 * 10/2004 Taplan et al. ..... 126/39 B
6,978,778 B2 * 12/2005 Hawkins et al. ..... 126/215

* cited by examiner

*Primary Examiner*—Steven B McAllister
*Assistant Examiner*—Sarah Suereth
(74) *Attorney, Agent, or Firm*—George L. Rideout, Esq.; Armstrong Teasdale LLP

(57) ABSTRACT

In one aspect, an air inlet system for a gas cooking apparatus is provided having at least one gas burner and a burner box around the gas burner. The air inlet system has a sealed cooktop configured to cover the burner box. The cooktop has at least one peripheral vent cut configured to vent outside air into the burner box to provide air for the gas burner. The system further includes a vent trim attached to the cooktop and covering the vent cut. The vent trim has a surface with openings above a top surface of the cooktop. The openings are configured to allow outside air to enter the vent cut through the vent trim.

22 Claims, 9 Drawing Sheets

AIR-INLET ASSEMBLY FOR A GAS COOKING APPLIANCE

CROSS REFERENCE TO RELATED APPLICATIONS

This application is a continuation-in-part of U.S. application Ser. No. 10/248,973, filed Mar. 6, 2003now U.S. Pat. No. 6,729,323, and entitled "Air Inlet Assembly for a Gas Cooking Appliance," which is hereby incorporated by reference in its entirety.

BACKGROUND OF THE INVENTION

This invention relates generally to gas cooking appliances, and, more particularly, to an air-inlet assembly for a cooking appliance and cooking appliances incorporating such air inlet assemblies.

Gas fired stoves, ovens, and ranges typically include one or more gas heating units coupled to a main gas line to the appliance and providing fuel to the heating units, sometimes referred to as burners. In a domestic range, a gas line is connected to a distribution manifold within the appliance to direct gas to a plurality of surface burners on a cooktop or to baking elements within an oven cavity. Operation of the surface burners is usually accomplished with burner control knobs located on the front wall of the appliance in front of the cooktop or on the cooktop surface. Below each knob is a circular orifice, which allows air to pass down into the burner box of the cooktop. When a control knob is actuated, fuel is supplied to associated burners and an ignition module creates a spark to ignite the gas and produce a flame.

Electronic, touch-sensitive control interfaces are becoming increasingly popular in modern ranges and cooktops to control a variety of cooking elements. By implementing electronic touch controls on a gas cooktop, the opening beneath the control knobs is eliminated as a source of air for the burner box.

BRIEF DESCRIPTION OF THE INVENTION

Some aspects of the present invention provide an air inlet system for a gas cooking apparatus having a cooktop, at least one gas surface burner and a burner box around the gas burner, covered by the cooktop. The cooktop has at least one peripheral vent cut configured to vent outside air into the burner box to provide air for the gas burner. The system further includes a vent trim attached to the cooktop and covering the vent cut. The vent trim has a surface with openings above a top surface of the cooktop. The openings are configured to allow outside air to enter the vent cut through the vent trim.

In yet other aspects, the present invention provides an air inlet system for a gas cooking apparatus having a cooktop, at least one gas surface burner and a burner box around the gas burner, covered by the cooktop. The cooktop also has at least one peripheral vent cut configured to vent outside air into the burner box to provide air for the gas burner. The system also includes an elongate cover member attached to the cooktop and covering the vent cut. The cover member has a surface with openings configured to allow outside air to enter the vent cut through the cover member. The cover member also includes a raised surface isolating the openings from spills on the cooktop.

In still other aspects, the present invention provides a gas cooking apparatus having a cooktop, at least one gas surface burner and a burner box around the gas burner, covered by the cooktop. The cooktop has at least one peripheral vent cut configured to vent outside air into the burner box to provide air for the gas burner. The gas cooking apparatus also includes a vent trim attached to the cooktop and covering the vent cut. The vent trim has a surface with openings above a top surface of the cooktop. The openings are configured to allow outside air to enter the vent cut through the vent trim.

In yet other aspects, the present invention provides a gas cooking apparatus that includes a cooktop, at least one gas surface burner and a burner box around the gas burner, covered by the cooktop The cooktop also has at least one peripheral vent cut configured to vent outside air into the burner box to provide air for the gas burner. The gas cooking apparatus also has an elongate cover member attached to the cooktop and covering the vent cut. The cover member has a surface with openings configured to allow outside air to enter the vent cut through the cover member. The cover member also has a raised surface isolating the openings from spills on the cooktop.

It will be appreciated that configurations of the present invention can be utilized to direct air to a burner box to supply sufficient air to ignite a gas supply and produce a flame while preventing food or liquid from entering the burner box. As a result, configurations of the present invention improve the performance of a gas unit as well as the ability to clean the cooktop in a cost effective and time-saving manner.

DETAILED DESCRIPTION OF THE INVENTION

The term cooktop as used herein refers to a surface cooking system that includes at least one gas surface burner. A cooktop system can be a stand-alone unit that is mounted, for example, on a kitchen countertop. A cooktop system also can be integrated with an oven to form a range. Such cooktops and ranges are commercially available from the General Electric Company.

Gas cooktop systems typically have a generally planar glass-ceramic or porcelain cooking surface with heating units at the cooking surface. Each surface burner may be operable at various power levels. Prior to operation, a user typically positions a pot or pan containing food on the cooking surface over a burner to be operated and selects, via a user interface, a desired power setting for the burner. The cooktop system responds by supplying gas to the selected heating element in accordance with the user selected power setting.

Figure 1:
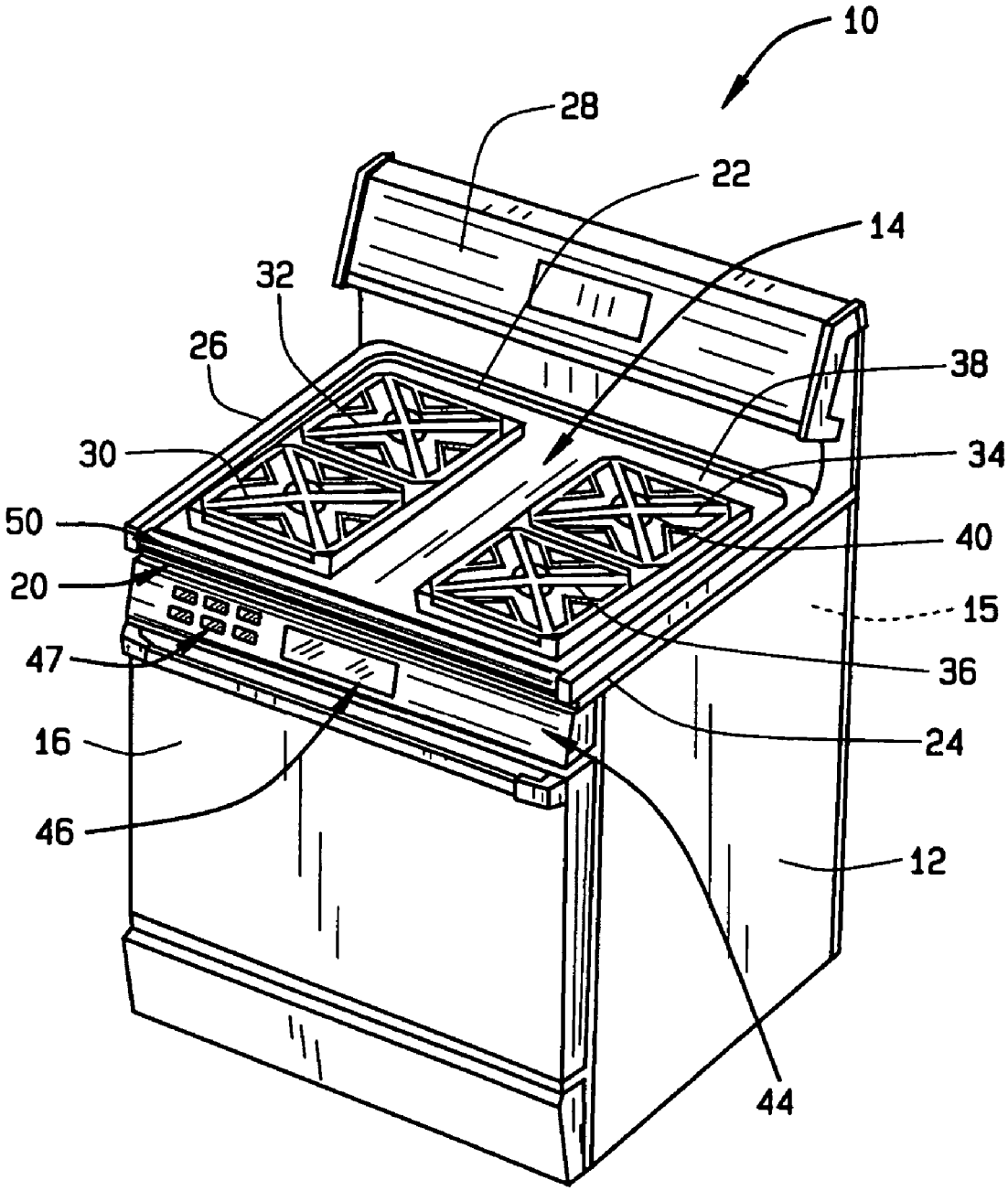
FIG. 1 illustrates an exemplary free standing gas range.
Figure 2:
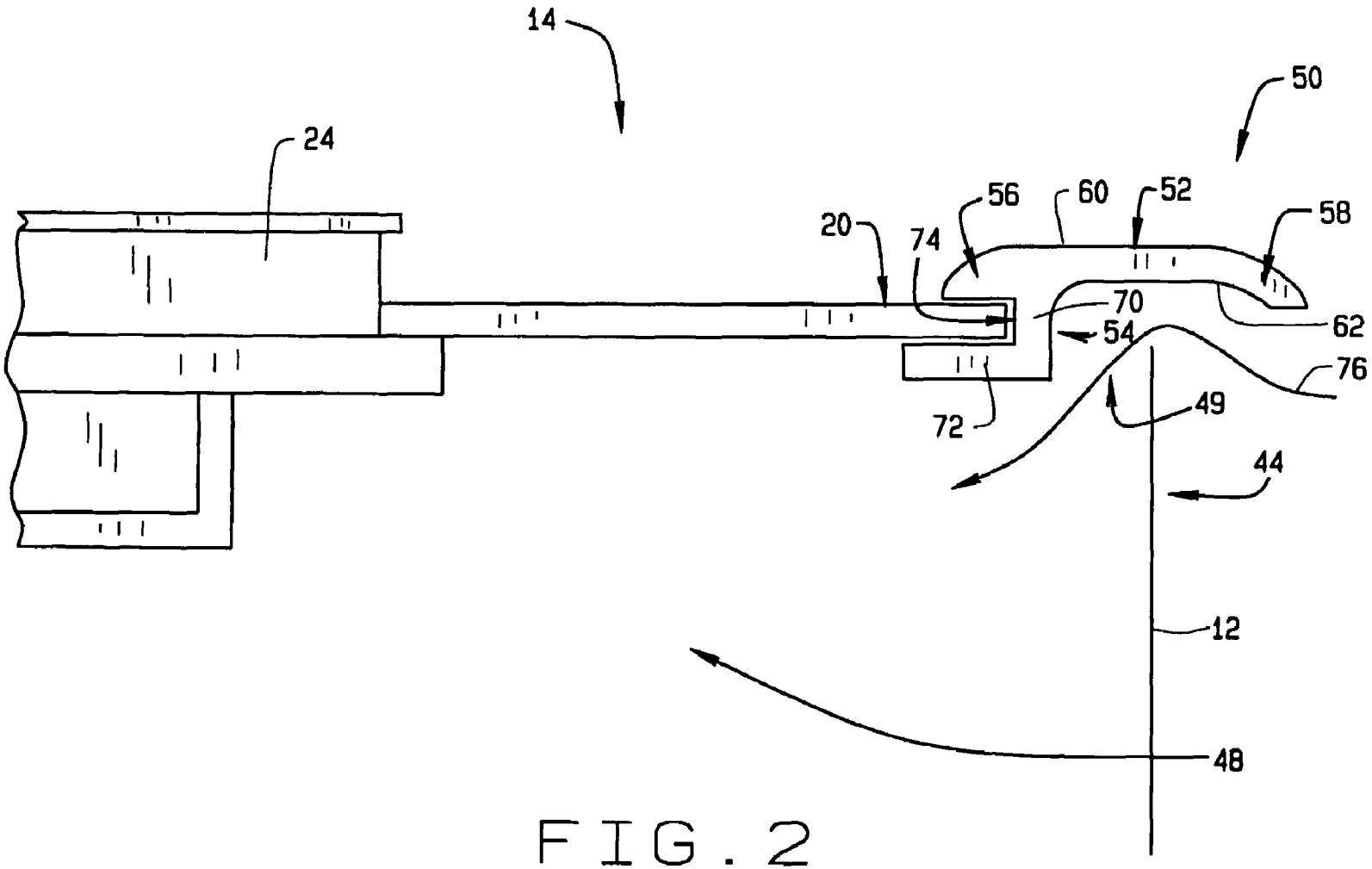
FIG. 2 is a side view of a louver attached to the gas range shown in FIG. 1.

FIG. 1 illustrates a gas cooking appliance in the form of a free standing gas range 10 including an outer body or cabinet 12 that incorporates a generally rectangular cooktop 14. FIG. 2 is a side view of cooktop 14. An oven 15 is positioned below cooktop 14 and has a front-opening access door 16. Cooktop 14 has a front edge 20, a rear edge 22 and side edges 24 and 26 extending between front edge 20 and rear edge 22. A range backsplash 28 extends upward of rear edge 22 of cooktop 14 and contains various control selectors (not shown) for selecting operative features of heating elements for cooktop 14 and the oven. It is contemplated that the benefits of the present invention are applicable not only to cooktops that form the upper portion of a range, such as range 10, but to other forms of cooktops as well, such as, but not limited to, cooktops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the benefits of the present invention are applicable to dual fuel cooking appliances, e.g., a gas cooktop with an electric oven.

Cooktop 14 includes four gas fueled cooking elements or burners 30, 32, 34 and 36 which are positioned in spaced apart pairs 30, 32 and 34, 36 positioned adjacent each side of a top face 38 of the cooktop 14. Each pair of burners 30, 32, and 34, 36 is surrounded by a recessed area (not shown in FIG. 1) respectively, of cooktop 14. The recessed areas serve to catch any spills from cooking utensils being used with cooktop 14. Each burner 30, 32, 34 and 36 extends upwardly through an opening in cooktop 14, and a grate assembly 40 is positioned over each respective pair of burners 30, 32 and 34, 36. Typically, each of the burners 30, 32, 34 and 36 of cooktop 14 are connected by a gas line (not shown) to a manifold (not shown). The construction and operation of the cooktop gas burners are believed to be within the purview of those in the art without further discussion.

In one embodiment, an inlet interface panel 44 includes a display 46 and a plurality of inlet selectors 47 in the form of touch sensitive buttons or keypads for accessing and selecting oven features. In alternative embodiments, other known inlet selectors are used in lieu of touch sensitive switches.

Unlike burner control knob type ovens, inlet interface panel 44 does not have orifices to allow air to enter a burner box 48 underneath cooktop 14. Therefore, front edge 20 of cooktop 14 is shortened with respect to cabinet 12 defining a gap 49 between front edge 20 and cabinet 12. Gap 49 permits air to enter burner box 48 so as to mix with the gas to ignite and produce a flame.

In the illustrative embodiment of FIG. 2, a louver 50 is fitted on front edge 20 of cooktop 14. Louver 50 guides air through gap 49 to provide air to the burner box 48 of cooktop 14. In one embodiment, at least one of side edges 24 and 26 is shortened with respect to cabinet 12 and louver 50 is mounted on at least one of side edges 24 and 26. In another embodiment, rear edge 22 is shortened with respect to cabinet 12 and louver 50 is mounted on rear edge 22. In another embodiment, louver 50 is made of stainless steel. In another embodiment, louver 50 is made of plastic. In one embodiment, louver 50 is secured to at least one of front edge 20, rear edge 22, and side edges 24 and 26 by an adhesive or a fastener.

Louver 50 has an airfoil portion 52 and an attachment portion 54. Airfoil portion 52 has a first end 56, a second end 58, a top surface 60, and a bottom surface 62. Top and bottom surfaces 60 and 62 extend between first and second end 56 and 58. In one embodiment, at least one of top and bottom surface 60 and 62 is curved.

Attachment portion 54 has a support member 70 extending from bottom surface 62 of airfoil portion 52. In one embodiment, support member 70 extends substantially perpendicular from bottom surface 62. Attachment portion 54 has a lip 72 extending substantially perpendicular to support member 70 so as to form a groove 74 between lip 72 and first end 56 of airfoil portion 52. As shown in FIG. 2, bottom surface 62 guides air, indicated by arrow 76, into and through gap 49 providing air to burner box 48. In one embodiment, louver 50 is a vent allowing excess heat to exhaust from burner box 48.

Figure 3:
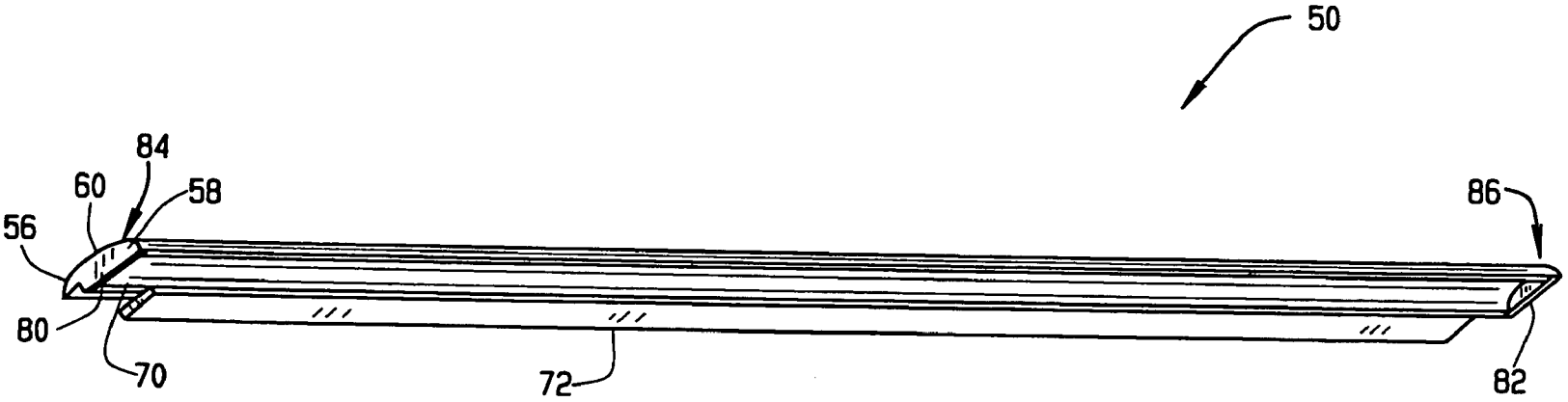
FIG. 3 is a bottom perspective view of the louver.

FIG. 3 is a bottom perspective view of louver 50. In the exemplary embodiment, louver 50 is elongate with side walls 80 and 82 at opposing ends 84 and 86. Sidewalls 80 and 82 prevent food and liquid from entering the burner box of cooktop 14. Lip 72 extends substantially along the length of louver 50. In one embodiment, louver 50 has at least one section along the length of louver 50 without airfoil portion 52 to accommodate various cooktop designs or structures, such as grate assembly 40. In another embodiment, louver 50 has at least one section along the length of louver 50 without attachment portion 54 to accommodate various cooktop designs or structures. In a further embodiment, first end 56 of airfoil portion 52 has at least one cutout section to accommodate various cooktop designs or structures.

The above described louver directs air to the burner box thereby supplying sufficient air to ignite and produce a flame. In addition, the louver prevents food or liquid from entering the burner box. As a result, the louver improves the performance of a gas unit and improves the cleanability of the cooktop in a cost effective and time-saving manner.

Figure 4:
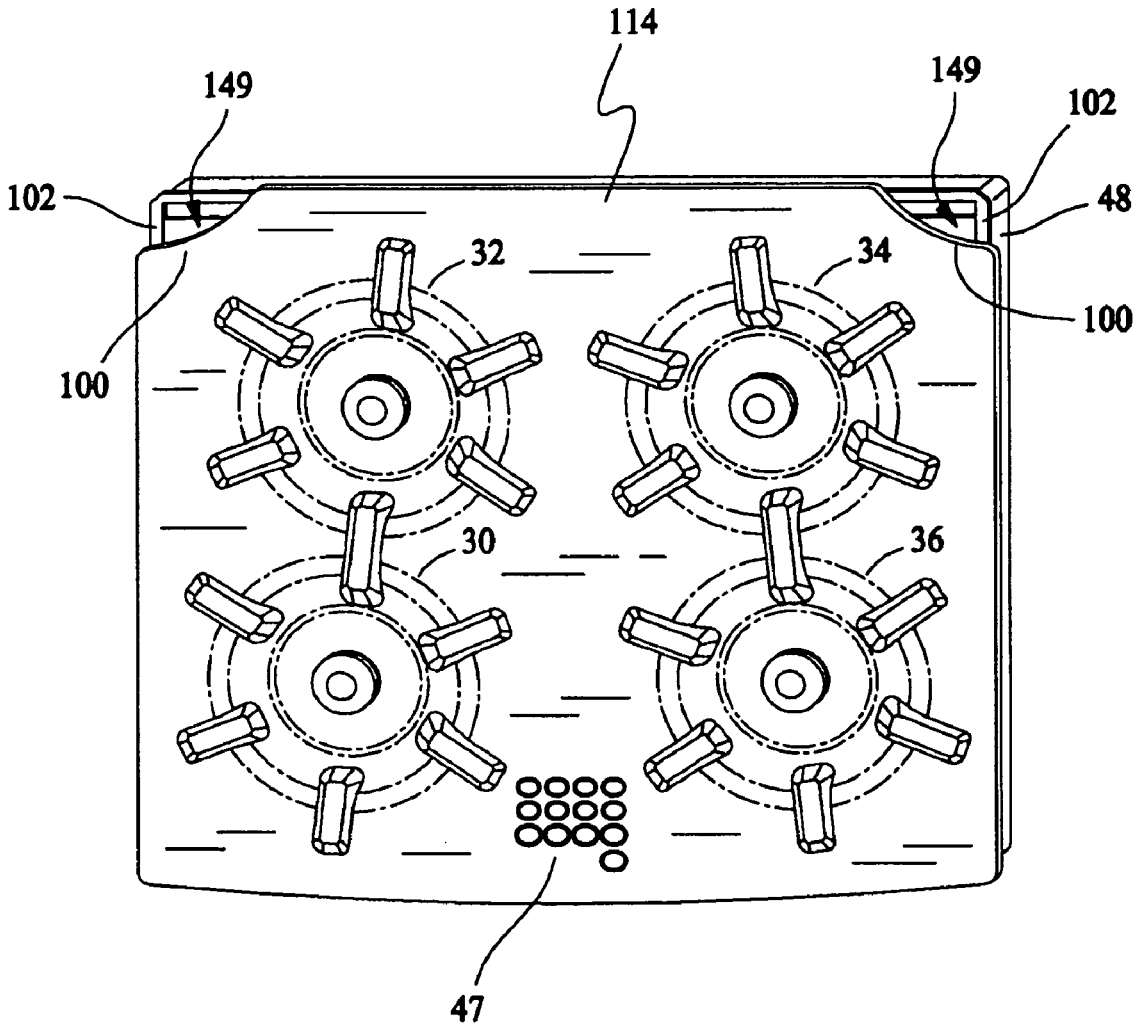
FIG. 4 is a top perspective view of a configuration of a gas cooktop having corner cuts, wherein the gas cooktop is sitting over a burner box of a cooking apparatus, which is, for example, a gas range.

In another configuration and referring to FIG. 4, a burner box 48 of a cooking apparatus (for example, a gas range) is provided around one or more cooking elements or gas burners 30, 32, 34, 36. Burner box 48 is covered with a cooktop 114. Cooktop 114 can rest on and/or be sealed to a lip 102 of burner box 48. Cooktop 114 may be flat or may be formed so as to include recessed areas to catch spills. Cooktop 114 has a least one peripheral vent cut 100 that is configured to vent outside air 149 into burner box 48 to provide air for the one or more gas burners 30, 32, 34, 36. Vent cut 100 can be, but is not required to be located at a corner of cooktop 114. Electronic inlet selectors or controls 47 are provided on a top surface of the cooktop.

Figure 5:
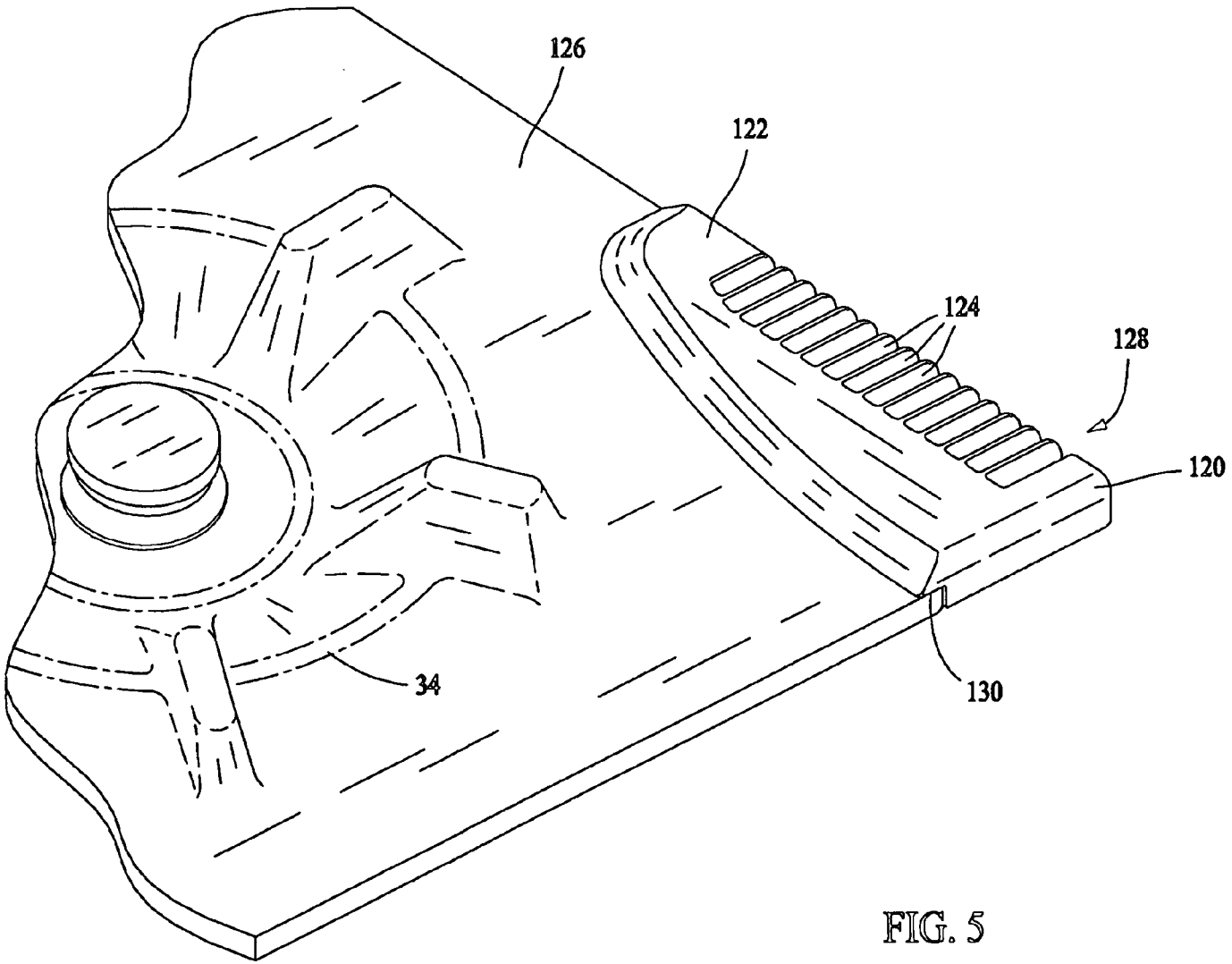
FIG. 5 is a top perspective view of a configuration of a vent trim covering a vent cut of the cooktop shown in FIG. 4.

In the illustrative embodiment of FIG. 5, vent cut 100 is covered by a vent trim 120 having a surface 122 having openings 124 raised above a top surface 126 of cooktop 114. Openings 124 allow outside air to enter through vent cut 100 so that outside air is supplied to the one or more gas cooking elements 30, 32, 34, 36. Because surface 122 is raised above cooktop surface 126, spills on the cooktop are effectively prevented from entering burner box 48. For example, surface 122 is raised above cooktop surface 126 between about 0.125 in (about 0.318 cm) to about 0.3 in (about 0.762 cm) to impede a spill of that height from entering openings 124. A maximum height for surface 122 is more likely to be determined in most configurations from aesthetic rather than air intake considerations. For example, in some configurations, surface 122 is raised by between 0.3 in (0.762 cm) to as much as much 1.0 in (2.54 cm) or more.

In some configurations vent trim 120 includes a venting portion shown generally at 128 and an attachment portion shown generally at 130. Attachment portion 130 overlaps a portion of surface 126 so that the overlapping portion of vent trim 120 can be adhesively sealed to surface 126 of cooktop 114. In particular, some configurations of the present invention provide a water-tight adhesive seal to prevent liquids spilled on cooktop 114 from entering burner box 48. Suitable adhesives include, but are not limited to, very high bonding double-sided adhesive tape.

Figure 6:
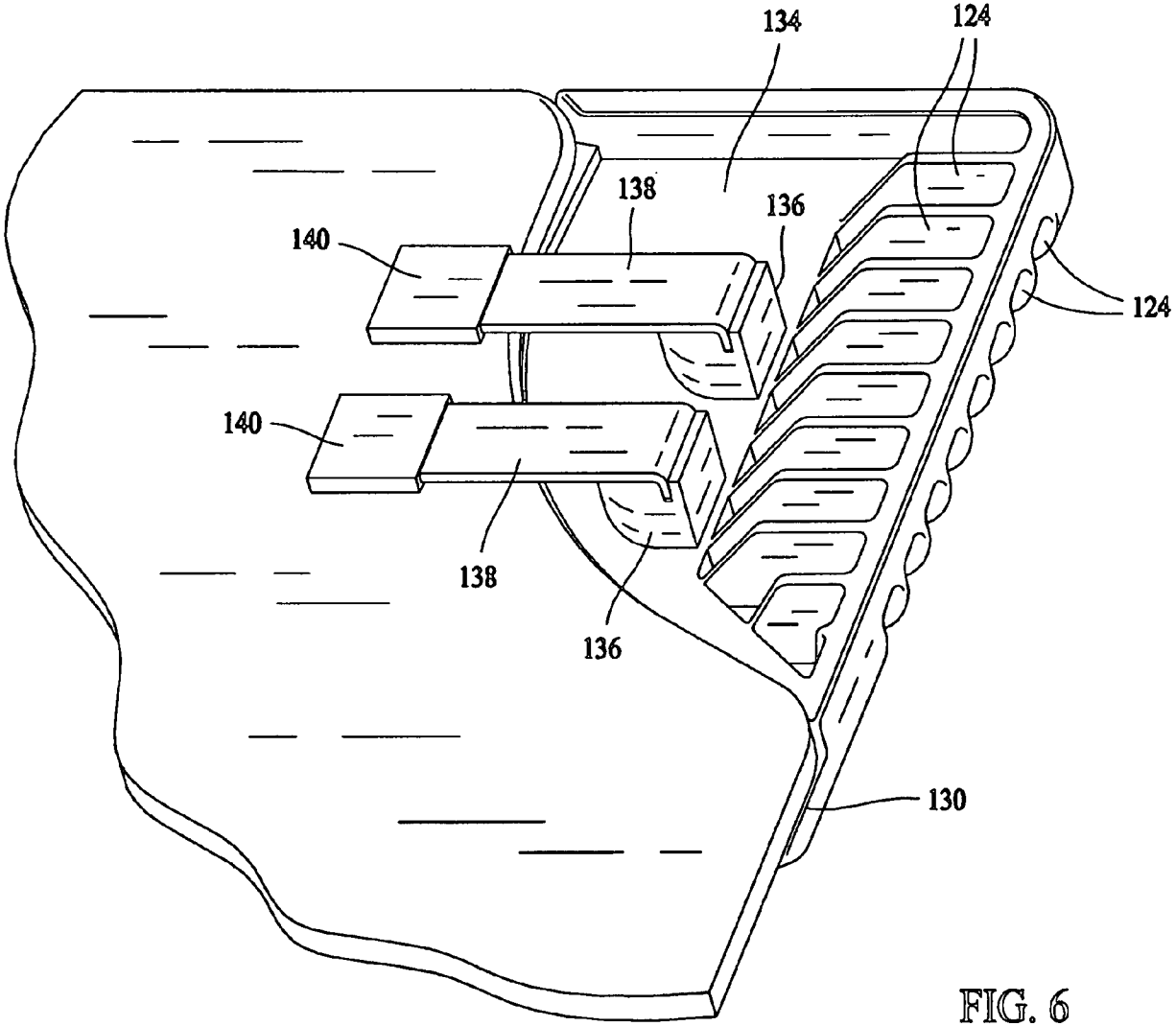
FIG. 6 is a bottom perspective view of the vent trim and cooktop shown in FIG. 5, illustrating one of several ways in which the vent trim can be attached to the cooktop.

In some configurations and referring to FIG. 6, vent trim 120 is fixedly attached to cooktop 114 utilizing one or more clips such as metal clips 138. In the illustrated example configuration, a pair of clips 138 fixedly attach between a mounting portion 136 inside a recessed region 134 of vent trim 120 and clip retainers 140 fixedly attached to an underside 132 of cooktop 114. Some configurations utilize one or more clips 138 as well as adhesive at attachment portion 130 to ensure a water-tight seal. Also in some configurations and referring to FIG. 4, vent cut 100 is at a rear corner of cooktop 114, or at more than one rear corner of cooktop 114. However, the one or more vent cuts 110 are not required to be located at rear corners of cooktop 114, and one or more may be located at front corners.

In some configurations of the present invention, cooktop 114 comprises formed glass, and vent trim 120 is a color matched die cast metal part. In some configurations having a flat glass cooktop 114 with a cast grate, a stainless steel vent trim 120 can be used.

Figure 7:
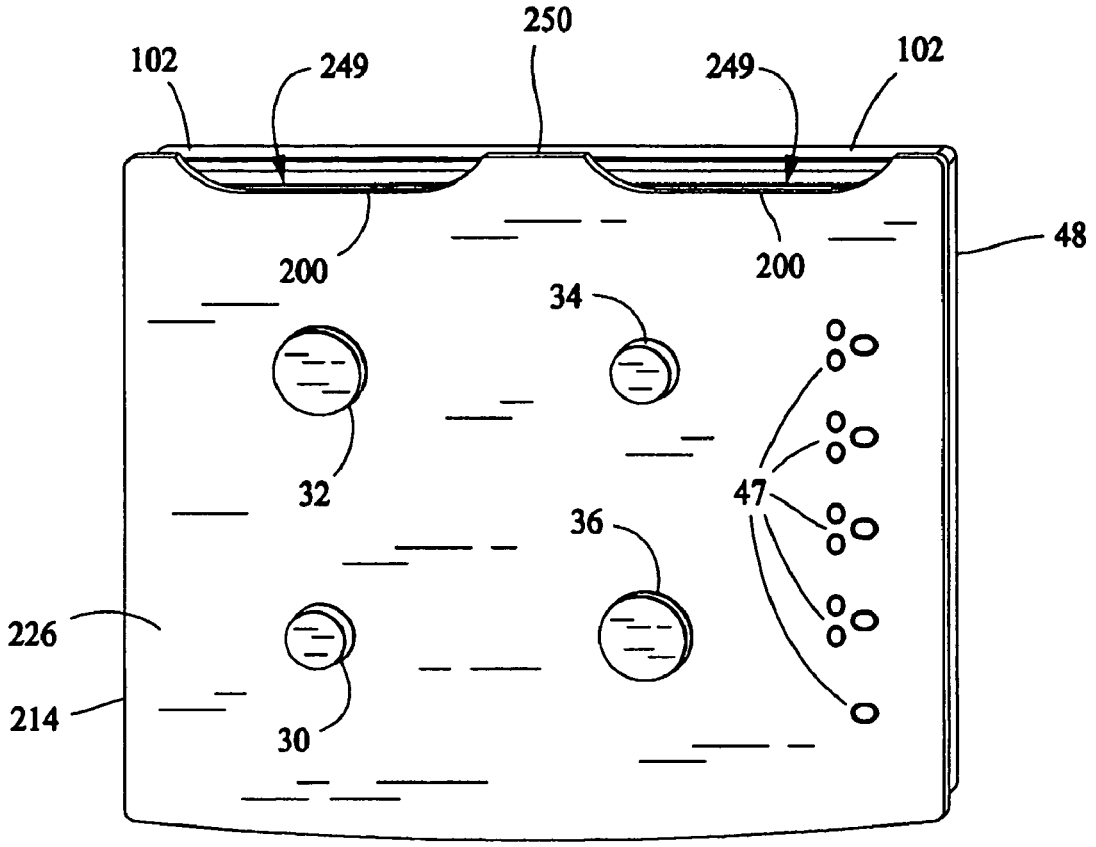
FIG. 7 is a top perspective view of a gas cooktop configuration having side vent cuts, wherein the gas cooktop is sitting over a burner box of a cooking apparatus, which is, for example, a gas range.
Figure 8:
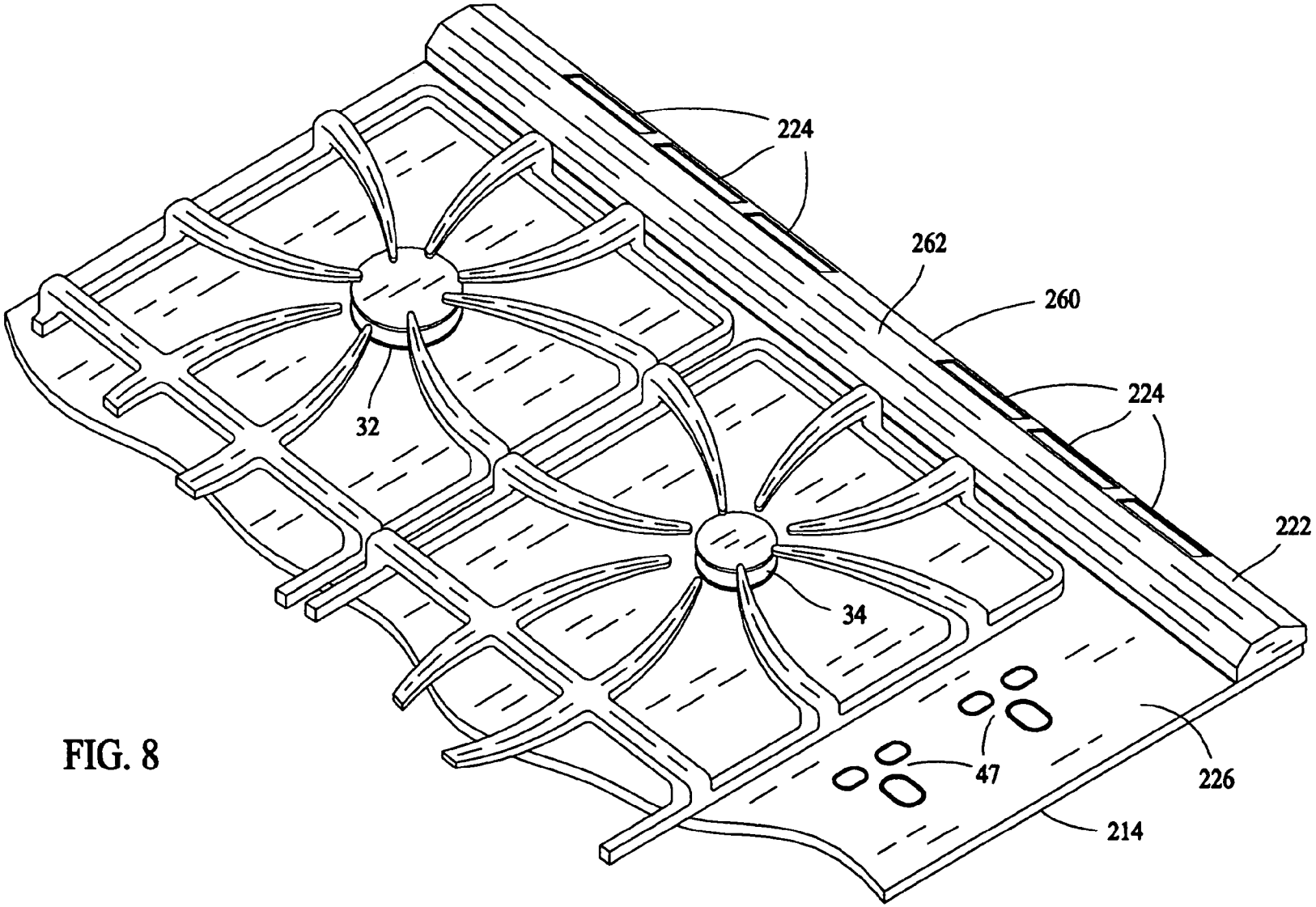
FIG. 8 is a top perspective view of the gas cooktop configuration of FIG. 7 showing an elongate cover member covering the side vent cuts of the cooktop.
Figure 9:
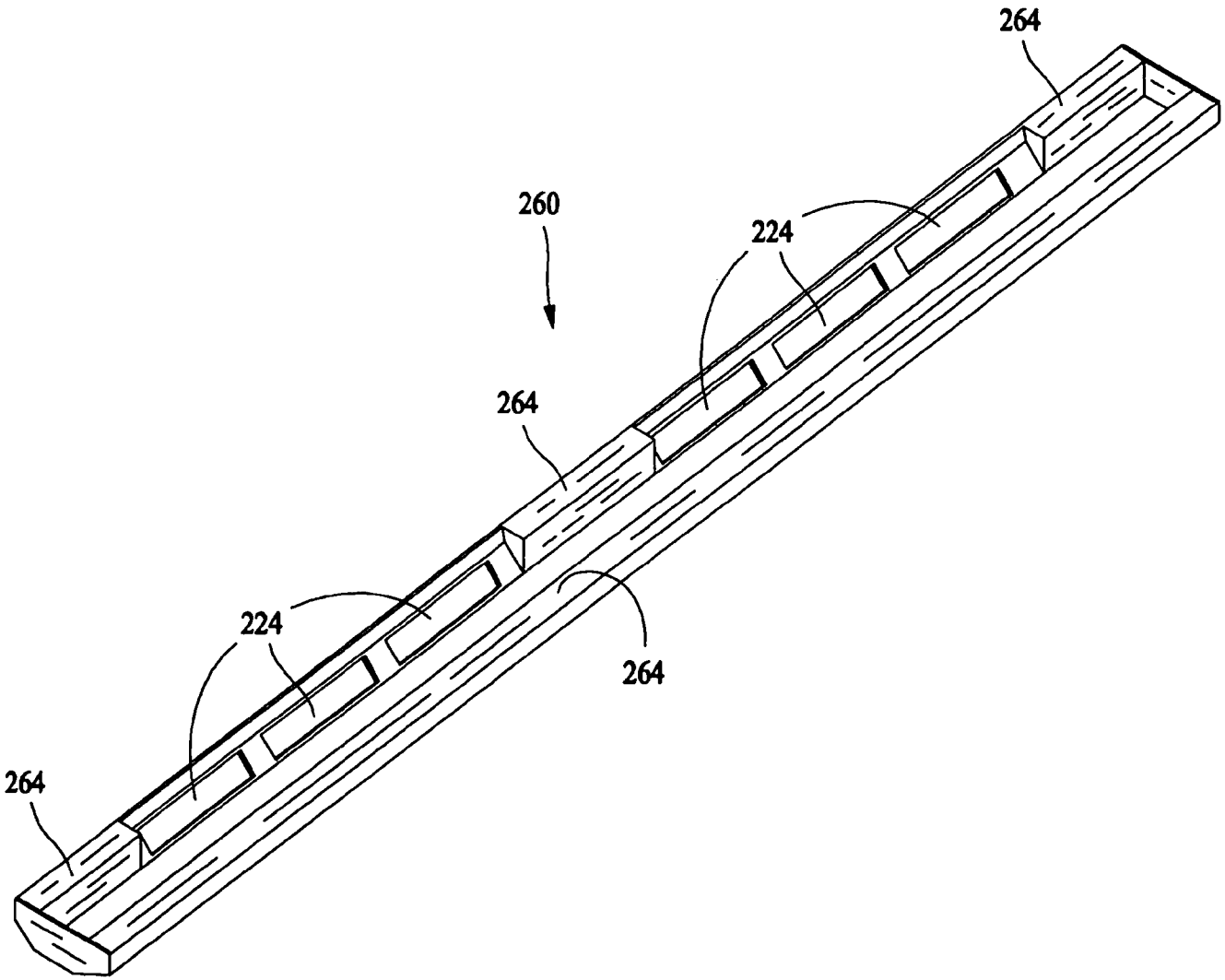
FIG. 9 is a bottom perspective view of a configuration of elongate cover member suitable for use as the elongate cover member of FIG. 8.

In some configurations of the present invention vent cuts can be located along an edge of a cooktop, with the vent trim appropriately shaped to cover the edge vent cuts. For example, in the illustrative embodiment of FIG. 7, a cooktop 214 (either flat glass or formed glass) is provided with one or more peripheral vent cuts 200 along an edge 250. Vent cuts 200 can be along an edge of cooktop 214 exclusive of a corner of cooktop 214. Air is guided into burner box 48 by providing a burner box 48 around one or more gas burners 30, 32, 34, 36. Sealed cooktop 214 is provided, wherein cooktop 214 is configured to cover burner box 48. Cooktop 214 also has at least one peripheral vent cut 200 that is configured to vent outside air through gap 249 into burner box 48 to provide air for the one or more gas burners 30, 32, 34, 36. In addition, and referring to FIG. 8, an elongate cover member 260 is provided. Elongate cover member 260 is attached to cooktop 214 at a top surface 226. Cover member 260 has a surface 222 with openings 224 that are configured to allow outside air to enter vent cut or cuts 200 through cover member 260. Cover member 260 also has a raised portion 262 isolating openings 224 from spills on cooktop 214. Cover member 260 can extend along an entire side 250 of top face 226 of cooktop 214. Cover member 260 can be made of cast metal such as stainless steel, although other materials and methods of making cover member 260 (e.g., sheet metal) are also contemplated. In some configurations and referring to FIG. 9, elongate cover member 260 includes tabs or surfaces 264 on its underside wherein an attachment can be made to surface 226 of cooktop 214 utilizing an adhesive. A water-tight adhesive attachment can be provided utilizing, for example, high bond strength double-sided adhesive tape.

The above described air inlet systems can be utilized in a gas cooking apparatus such as gas range 10 to direct air to a burner box to supply sufficient air to ignite a gas supply and produce a flame. In addition, each of the above-described air inlet systems prevents food or liquid from entering the burner box. As a result, the air inlet system improves the performance of a gas unit and improves the cleanability of the cooktop in a cost effective and time-saving manner.

While the invention has been described in terms of various specific embodiments, those skilled in the art will recognize that the invention can be practiced with modification within the spirit and scope of the claims.

What is claimed is:

1. An air inlet system for a gas cooking apparatus comprising at least one gas burner and a burner box around the at least one gas burner, said air inlet system comprising:

a cooktop configured to cover the burner box and having at least one peripheral vent cut configured to vent outside air into the burner box to provide air for the at least one gas burner, said at least one peripheral vent cut defining a first opening through said cooktop; and a vent trim attached to said cooktop and covering said at least one peripheral vent cut, said vent trim comprising a top surface offset a distance above a top surface of said cooktop, said vent trim top surface comprising a plurality of second openings defined therein, said second openings aligned above said at least one peripheral vent cut, said vent trim facilitating isolating said plurality of second openings from spills on said cooktop, an attachment portion overlapping said top surface of said cooktop, said attachment portion extending along substantially a full length of said at least one peripheral vent cut, and at least one clip overlapping a bottom surface of said cooktop, said vent trim surface defining an underlying cavity, wherein said at least one clip is partially positioned within said cavity under said vent trim and said cooktop, said at least one clip attached at a first end to a mounting portion inside a recessed region of said vent trim and at a second end to a clip retainer fixedly attached to said bottom surface of said cooktop, wherein said second openings are configured to allow outside air to enter the burner box through said vent trim.

2. A system in accordance with claim 1 wherein said attachment portion is sealed to said cooktop in water-tight engagement.

3. A system in accordance with claim 2 wherein said seal comprises adhesive tape.

4. A system in accordance with claim 1 wherein said first opening is defined at a rear corner of said cooktop.

5. A system in accordance with claim 4 wherein said cooktop has a plurality of vent cuts each disposed at one rear corner.

6. An air inlet system for a gas cooking apparatus having at least one gas burner and a burner box around the at least one gas burner, said air inlet system comprising:

a cooktop configured to cover the burner box and having at least one peripheral vent cut configured to vent outside air into the burner box to provide air for the at least one gas burner; and an elongated cover member attached to a top face and a bottom face of said cooktop and covering said at least one peripheral vent cut, said cover member having a top surface with openings configured to allow outside air to enter said at least one peripheral vent cut through said cover member, said top surface offset a distance above said top face of said cooktop and said at least one peripheral vent cut, said cover member facilitating isolating said openings from spills on said cooktop, said top surface defining an underlying cavity, said cover member comprising at least one tab engaging said top face, and at least one clip overlapping said bottom face of said cooktop, wherein said at least one clip is partially positioned within said cavity under said cover member and said cooktop, said at least one clip attached at a first end to a mounting portion inside a recessed region of said cover member and at a second end to a clip retainer fixedly attached to said bottom face of said cooktop.

7. A system in accordance with claim 6 wherein said cover member extends along an entire side of said top face of said cooktop.

8. A system in accordance with claim 6 wherein said at least one peripheral vent cut is along an edge of said cooktop exclusive of a corner of said cooktop.

9. A system in accordance with claim 8 wherein said cooktop has a plurality of vent cuts along said edge exclusive of said corner.

10. A system in accordance with claim 6 further comprising a seal for sealing said elongated cover member in water tight engagement along a side of said top face of said cooktop.

11. A system in accordance with claim 10 wherein said seal is an adhesive seal.

12. A gas cooking apparatus comprising:

at least one gas burner;

a burner box for said at least one gas burner;

a cooktop configured to cover said burner box and having at least one peripheral vent cut configured to vent outside air into said burner box to provide air for said at least one gas burner, said at least one peripheral vent cut defining a first opening through said cooktop; and a vent trim attached to said cooktop and covering said at least one peripheral vent cut, said vent trim comprising a top surface offset a distance above a top surface of said cooktop, and comprising a plurality of second openings defined therein, said plurality of second openings aligned above said at least one peripheral vent cut, said vent trim facilitating isolating said second openings from spills on said cooktop, an attachment portion overlapping said top surface of said cooktop, said attachment portion extending along a full length of said at least one peripheral vent cut, and at least one clip overlapping a bottom surface of said cooktop, said vent trim surface defining an underlying cavity, wherein said at least one clip is partially positioned within said cavity under said vent trim and said cooktop, said at least one clip attached at a first end to a mounting portion inside a recessed region of said vent trim and at a second end to a clip retainer fixedly attached to said bottom surface of said cooktop, wherein said second openings are configured to allow outside air to enter said burner box through said vent trim.

13. An apparatus in accordance with claim 12 wherein said attachment portion is sealed to said cooktop in water-tight engagement.

14. An apparatus in accordance with claim 13 wherein said seal comprises adhesive tape.

15. An apparatus in accordance with claim 12 wherein said first opening is defined at a rear corner of said cooktop.

16. An apparatus in accordance with claim 15 wherein a plurality of said peripheral vent cuts are each disposed at more than one rear corner of said cooktop.

17. A gas cooking apparatus comprising:

at least one gas burner;

a burner box for said at least one gas burner;

a sealed cooktop configured to cover said burner box and having at least one peripheral vent cut configured to vent outside air into said burner box to provide air for said gas burner; and an elongated cover member attached to a top face and a bottom face of said cooktop and covering said at least one peripheral vent cut, said cover member having a top surface with openings configured to allow outside air to enter said at least one peripheral vent cut through said cover member, said top surface offset a distance above said top face of said cooktop and said at least one peripheral vent cut, said cover member facilitating isolating said openings from spills on said cooktop, said surface defining an underlying cavity, said cover member comprising at least one tab engaging said top face, and at least one clip overlapping said bottom face of said cooktop, wherein said at least one clip is partially positioned within said cavity under said cover member and said cooktop, said at least one clip attached at a first end to a mounting portion inside a recessed region of said cover member and at a second end to a clip retainer fixedly attached to said bottom face of said cooktop.

18. An apparatus in accordance with claim 17 wherein said cover member extends along an entire side of said top face of said cooktop.

19. An apparatus in accordance with claim 17 wherein said at least one peripheral vent cut is along an edge of said cooktop exclusive of a corner of said cooktop.

20. An apparatus in accordance with claim 19 wherein said cooktop has a plurality of vent cuts along said edge exclusive of said corner.

21. An apparatus in accordance with claim 17 further comprising an attachment for attaching said elongated cover member in water tight engagement along a side of said top face of said cooktop.

22. An apparatus in accordance with claim 21 wherein said attachment comprises adhesive tape.

* * * * *